33-233 SR
1/21/86 OR 4,565,009

United States Patent [19]
Porter

[11] Patent Number: 4,565,009
[45] Date of Patent: Jan. 21, 1986

[54] SIGHTING APPARATUS

[76] Inventor: Wade T. Porter, Box 1091, Worland, Wyo. 82401

[21] Appl. No.: 683,050

[22] Filed: Dec. 18, 1984

[51] Int. Cl.[4] ..... F41G 1/00
[52] U.S. Cl. ..... 33/233; 33/265
[58] Field of Search ..... 33/233, 234, 265

[56] References Cited

U.S. PATENT DOCUMENTS 1,476,884 12/1923 Gregory ..... 33/233
3,886,667 6/1975 Rueb ..... 33/233

*Primary Examiner*—Willis Little
*Attorney, Agent, or Firm*—Arthur L. Urban

[57] ABSTRACT

Sighting apparatus includes a support portion, a connecting portion, a leveling portion and an aligning portion. The support portion includes securing mechanism disposed adjacent one end and being affixable to a member to be sighted. The connecting portion includes a connector adjacent the securing mechanism. The leveling portion includes linear sections extending in opposite directions from the support portion with the linear sections being disposed in a single plane. The aligning portion includes aiming sections with one of the aiming sections located on each side of the support portion. A part of each aiming section being spaced from a corresponding part of the other aiming section a distance substantially equal to spacing between a user's eyes. The sighting apparatus is mounted through the securing mechanism on a member to be sighted. Focusing on a target along the member with both eyes open creates a double image including a pair of adjacent sighting apparatus in which the aiming sections overlap at a common point aligned with the target.

16 Claims, 7 Drawing Figures

FIG. 1
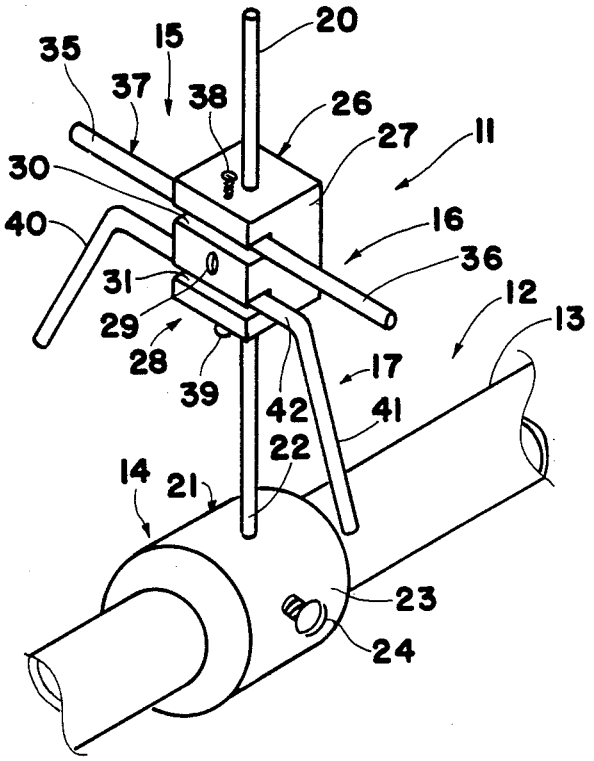
FIG. 2
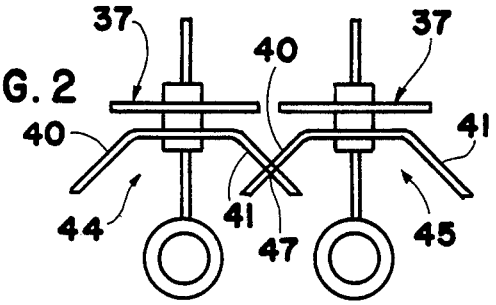
FIG. 4
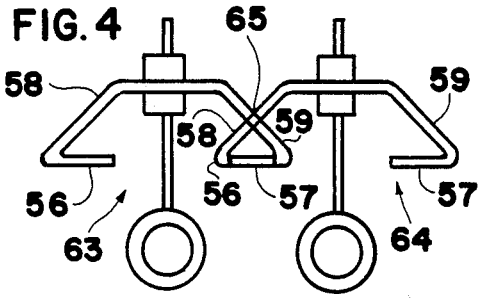
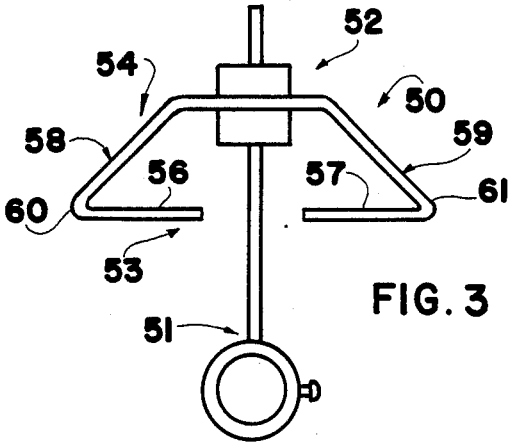
FIG. 3
FIG. 5
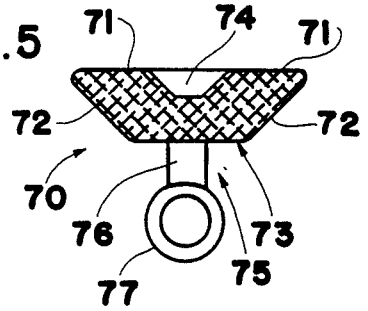
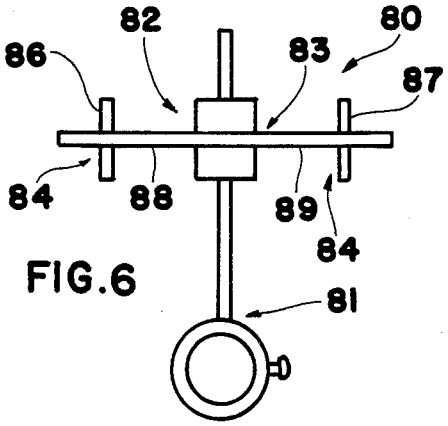
FIG. 6
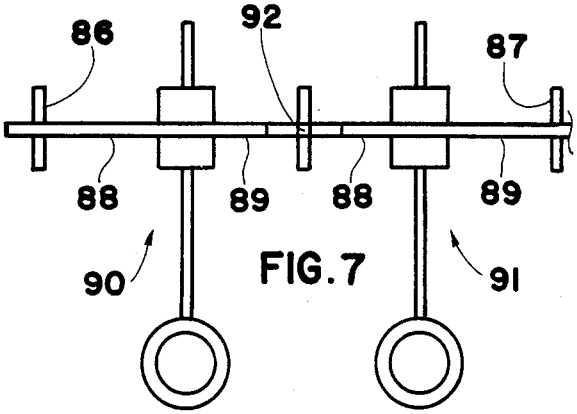
FIG. 7

SIGHTING APPARATUS

This invention relates to a novel sighting apparatus and more particularly relates to a new apparatus for sighting with weapons.

Since man developed weapons many centuries ago, a great deal of time and effort has been directed toward improving the accuracy of such devices. With some weapons such as bow and arrows, a person simply positions the bow with the arrow in place against the side of the face so one eye is behind the arrow. In this position, an individual can peer along the length of the arrow to establish that it is pointed toward the target.

Firearms also are designed to allow one eye to be positioned at the end of the gun barrel. Thus, the gun is aimed in much the same way as with a bow with an eye sighting along the barrel to insure proper alignment with the target.

In recent years, the design of weapon sights has been refined to include sighting devices that can be adjusted to compensate for the trajectory of the projectile. Also, telescopic sights have been developed to increase the accuracy of the weapon at long distances. In general, sighting device improvements have evolved within the premise that one eye will be positioned behind the projectile adjacent the line of flight.

Although this aiming technique is successful for weapons such as bow and arrows and rifles, it is not adaptable to other weapons. One example of a weapon that is not aimed with one eye along the projectile trajectory is the blowgun. Since a blowgun is positioned with one end in the mouth which is spaced between the two eyes, neither eye can be placed directly over the blowgun unless the head is tilted into an awkward position. In view of this displacement of the eyes with respect to the centerline of the blowgun when the head is in a normal position, single eye sighting is not successful.

Thus, blowgun users in the past have had to devise a different sighting procedure. This generally has involved repeated trial and error over a long period of time to develop a makeshift method of aiming. Ordinarily, the blowgun simply is pointed in the general direction of the target with some compensation for the trajectory of the projectile.

Because of this very primitive aiming procedure, accuracy with a blowgun is quite low as compared with common weapons such as bows and guns. As a result, only persons who have a special aptitude and skill in using a blowgun achieve a reasonable degree of accuracy. Those who do not achieve a degree of accuracy with a blowgun equivalent to their experience with other weapons quickly can lose interest in the sport and discontinue blowgun use.

This situation results in only a few persistant individuals continuing in the sport for any significant time period. Thus, blowgun shooting has had only limited appeal and is not very popular.

From the above discussion, it is clear that previous methods and devices for sighting do not provide a satisfactory level of performance for most blowgun users. Thus, there is a need for a new sighting apparatus that overcomes the shortcomings of earlier devices.

The present invention provides a novel sighting apparatus with features and advantages not found in previous devices and methods. The sighting apparatus of the invention enables a person to achieve a much higher degree of accuracy in his blowgun shooting as compared with earlier devices. Also, the sighting apparatus enables a neophyte to attain a reasonable level of performance quickly and easily. This ability to enjoy the sport after a minimum of training and experience increases the probability that an individual will maintain an interest in the sport instead of dropping it because of discouragement at not being able to reach a satisfactory performance level in a reasonable period of time.

The sighting apparatus of the present invention is simple in design and can be produced relatively inexpensively. Commercially available materials and components can be used in its manufacture. Conventional fabrication techniques and procedures and semi-skilled labor can be utilized to produce the sighting apparatus.

The sighting apparatus of the present invention can be used effectively by persons with limited weapon experience after only a minimum of instruction. The apparatus can be mounted on a blowgun quickly and conveniently. The sighting apparatus can be adjusted for a particular person's needs easily without special tools. The sighting apparatus can be modified to meet specific shooting conditions. The sighting apparatus can be employed with other weapons and other sighting endeavors, if desired.

These and other benefits and advantages of the novel sighting apparatus of the present invention will be apparent from the following description and the accompanying drawings in which:

FIG. 1 is a view in perspective of one form of the sighting apparatus of the invention mounted on a blowgun;

FIG. 2 is a schematic illustration of an image that a person discerns when aiming with both eyes open in the use of the sighting apparatus shown in FIG. 1;

FIG. 3 is a side elevation of another form of the sighting apparatus of the invention;

FIG. 4 is a schematic illustration of an image that a person discerns when aiming with both eyes open in the use of the sighting apparatus shown in FIG. 3;

FIG. 5 is a side elevation of another form of the sighting apparatus of the invention;

FIG. 6 is a side elevation of an additional form of the sighting apparatus of the invention; and FIG. 7 is a schematic illustration of an image that a person discerns when aiming with both eyes open in the use of the sighting apparatus shown in FIG. 6.

As shown in FIGS. 1 and 2 of the drawings, one form of the sighting apparatus 11 of the present invention is mounted in a blowgun 12 including a tubular member or barrel 13. The sighting apparatus 11 includes a support portion 14, a connecting portion 15, a leveling portion 16 and an aligning portion 17.

The support portion 14 of the sighting apparatus 11 of the present invention includes a post member 20. Securing means 21 is disposed adjacent one end 22 of the post member 20 to affix same to a tubular member such as barrel 13.

The securing means 21 advantageously includes a nut or ring member 23 as shown or may simply be a threaded section (not shown) that engages the barrel itself. The post member preferably extends radially from the barrel or ring. With the ring 23, locking means such as a screw 24 preferably is included to affix the sighting apparatus 11 to the barrel.

The connecting portion 15 of the sighting apparatus 11 includes connector means 26. The connector means preferably is adjustably disposed along the post member 20. The connector means 26 is disposed along the post member at a point spaced from the securing means 21.

Advantageously, the connector means includes a yoke member 27 which is slidably disposed on the post member. Also, locking means 28 shown as set screw 29 is operatively connected to the yoke member to maintain the position thereof. The yoke member preferably includes horizontal slots 30 and 31 for the leveling and aligning portions 16 and 17 as will be described hereinafter.

The leveling portion 16 of the sighting apparatus 11 includes linear sections 35 and 36. The linear sections extend in opposite directions from the post member 20. The linear sections are disposed in a single plane substantially perpendicular to the post member. The linear sections 35 and 36 may be formed together as a unitary linear member 37 that extends in both directions from the connecting portion 15.

The aligning portion 17 of the sighting apparatus 11 of the invention includes aiming sections 40 and 41. The aiming sections are spaced from the post member 20. One of the aiming sections is located on each side of the post member. The spacing may be achieved through an expedient such as a common central section 42 as shown in FIG. 1 which engages slot 31 of the yoke member 27.

A part of each aiming section is spaced from a corresponding part of the other aiming section a distance substantially equal to the spacing between a user's eyes. With the aiming sections 40 and 41 being disposed at an acute angle to the linear sections 35 and 36 and the post member 20, the aiming sections provide a large number of spacings along their lengths to match the different eye spacings of particular persons.

The aiming sections also are disposed in a spacial relationship with respect to the linear sections. This is achieved in the construction shown in FIG. 1 by having the linear sections and the aiming sections all rigidly secured together through yoke member 27.

The sighting apparatus 11 is assembled by securing one end 22 of post member 20 to the periphery of ring member 23 so the post member extends radially therefrom. Yoke member 27 is slipped along the post member and secured thereto with set screw 29. Unitary linear section 37 then is inserted in slot 30 in the yoke member and secured with screw 38. In the same way, central section 42 of aligning portion 17 is inserted into slot 31 with the aiming sections 40 and 41 extending downwardly and secured with screw 39.

The assembled sighting apparatus is secured to barrel 13 by sliding ring member 23 over the barrel and adjusting the position of the sighting apparatus therealong to provide the user a sharp double image. Screw 24 is tightened in the ring member to fix the position of the apparatus. The sighting apparatus 11 now is ready for use.

With the blowgun 12 placed into the mouth, a user looks at a target (not shown) with the sighting apparatus in his line of sight. Having both of his eyes open, two distinct images in a side by side relationship are discernible as illustrated in FIG. 2. A left image 44 will be seen by the user's right eye, and a right image 45 by the user's left eye. The spacing of the two images 44 and 45 will depend upon the spacing between the eyes of the observer and the distance to the target.

Since the aiming sections 40 and 41 are disposed at an angle to the horizontal and the vertical, the aiming sections cross at a common point 47 along their lengths. The exact point of crossing will depend upon the eye spacing which determines the extent of overlap of the aiming sections. This crossing point 47 is aligned with a target to provide proper alignment of the blowgun.

Adjustment of the sighting apparatus to compensate for the distance to the target is achieved by raising or lowering the position of the yoke member 27 and the aiming sections 40 and 41 with respect to the post member 20. This change in position also moves the crossing point 47 of the aiming sections to provide a correction for the trajectory of the projectile being propelled.

The blowgun is properly aligned with the target when the two unitary linear sections 37 of the images 44 and 45 are in a continuing horizontal orientation as shown in FIG. 2. The sighting apparatus is not properly aligned when the sections 37 do not form a continuous line across the two images but instead are divided into two separate lines tilted upwardly on the same end of each segment 37. Proper alignment of the sighting apparatus 11 can be achieved by changing the inclination of the head and/or the inclination of the sighting apparatus until proper orientation of sections 37 is attained.

FIGS. 3 and 4 illustrate another form of sighting apparatus 50 of the present invention. As shown, sighting apparatus 50 includes a support portion 51, a connecting portion 52, a leveling portion 53 and an aligning portion 54. The support portion 51, the connecting portion 52 and the aligning portion 54 are similar to support portion 14, connecting portion 15 and aligning portion 17 of sighting apparatus 11.

The leveling portion 53 is different in that the linear sections 56 and 57 are extensions of the aiming sections 58 and 59 of the aligning portion 54. The linear sections 56 and 57 extend inwardly toward one another from the lower ends 60 and 61 of the aiming sections 58 and 59 respectively.

FIG. 4 schematically illustrates what would be discerned by the user as a pair of images 63 and 64 in a side by side relationship similar to those shown in FIG. 2. The aiming point is achieved in the same way as shown in FIG. 2 by the crossing 65 of the right aiming section 59 of left image 63 and the left aiming section 58 of the right image 64. Proper leveling of the sighting apparatus 50 is attained when the right linear section 57 of the left image 63 is superimposed over the left linear section 56 of the right image 64 and all of the linear sections are in the same horizontal line.

FIG. 5 shows a sighting apparatus 70 similar to sighting apparatus 50 of FIG. 3 with several differences. First, linear sections 71 and aiming sections 72 are inverted with the linear sections on top. Another change is that instead of the linear and aiming sections being wire or bar members, these sections are opaque lines or areas disposed on a common substantially flat base member 73 formed of a sheet of metal, plastic, glass, etc. Advantageously, the linear sections and the aiming sections are disposed along the periphery of the base member as shown in FIG. 5. Alternatively, transparent areas 74 of the base member may extend beyond these sections if desired. With a common base member, the connector portion 75 may be a simple fastener 76 that secures the base to a ring member 77 directly, if desired.

FIGS. 6 and 7 illustrate a different form of sighting apparatus 80. The sighting apparatus includes a support portion 81, a connecting portion 82, a leveling portion 83 and an aiming portion 84. The support portion 81 and the connector portion 82 are similar to the corresponding portions of the sighting apparatus 11 and 50. The aiming sections 86 and 87 are disposed transversely adjacent the ends of the linear sections 88 and 89.

With this configuration, an observer discerns the two images 90 and 91 (FIG. 7) in which two of the aiming sections are superimposed at a central aiming point 92. Since this structure includes perpendicularly disposed vertical aiming sections 86 and 87 rather than angled sections, compensation for differences in eye spacing of individuals is necessary. To provide for these differences, the spacing between the aiming sections on the sighting apparatus 80 is variable.

This can be accomplished by changing the lengths of the linear sections 88 and 89 or by moving the aiming sections along the linear sections. In place of the aiming bar sections 86 and 87 shown, other aiming sections such as rings, circles and similar configurations may be utilized to produce a common aiming point 92.

The various components of the sighting apparatus of the present invention may be adjusted to compensate for the many different variables encountered in sighting blowguns. The spacing of the eyes on the head is different for particular individuals as well as the height of one eye on the face with respect to the other. The target may be at short or long range.

The adjustments, unlike those with a rifle sight, are made in the direction of the error rather than toward the target itself. If the blowgun shoots low, the sight is moved down. If it shoots too high, the apparatus is moved upward. Similarly, if it shoots to the right, move the aiming section to the right, or if it shoots to the left, then move it to the left.

For longer ranges, the sight is moved lower, even to the extent that the weapon may be rotated 180° so that the sight is below the barrel. Beyond this point, the aiming sections can be moved downward away from the barrel to increase the range further. Longer ranges also can be achieved by moving the sight rearward on the barrel.

The sighting apparatus can be fabricated from a variety of different materials including metals, plastics, wood, combinations thereof and the like. Advantageously, the linear and aiming sections may be wires or bars. Another preferred combination is the coloring or other opacifying of part or all of a flat base member to provide linear and aiming sections. The connector portion may be a precision yoke member or a simple fastener such as a channel, bracket, clip, O-ring or the like which is of a design to hold the positions of the respective components in a fixed relationship to one another.

The above description and the accompanying drawings show that the present invention provides a novel sighting apparatus with features and advantages not found in previous sighting devices and methods. Through the use of the sighting apparatus of the invention, a person can achieve a much higher degree of accuracy in blowgun shooting more quickly and easily. A beginner can attain a reasonable level of performance while his initial enthusiasm for the sport still is high. Because of this, a greater number of people may develop a continuing interest in the sport and thereby markedly increase its popularity.

The sighting apparatus of the invention is simple in design and relatively inexpensive. The apparatus can be fabricated from commercially available materials and components using conventional manufacturing methods and employing semi-skilled labor. The sighting apparatus is relatively durable in construction and has a long useful life with a minimum of maintenance.

The sighting apparatus of the invention can be used effectively by persons of all ages, even those with limited weapon experience, after only a minimum of instruction. The apparatus can be mounted in position quickly and conveniently. Adjustments for specific facial configurations and shooting conditions can be made easily by individuals with little mechanical aptitude and without special tools.

It will be apparent that various modifications can be made in the particular sighting apparatus described in detail and shown in the drawings within the scope of the present invention. The size, configuration and arrangement of components can be changed to meet specific requirements. The apparatus can be mounted in different ways. The connector portion can be of another design. The linear and/or aiming sections can be of lighter or heavier construction and can be the same or more preferably of different thickness.

These and other changes can be made in the sighting apparatus of this invention provided the functioning and operation thereof are not adversely affected. Therefore, the scope of the present invention is to be limited only by the following claims.

I claim:

1. Sighting apparatus including a support portion, a connecting portion, a leveling portion and an aligning portion; said support portion including securing means disposed adjacent one end thereof, said support portion being affixable through said securing means to a member to be sighted, said securing means including a mounting ring member and locking means therefor, said support portion extending generally radially from said ring member; said connecting portion including connector means adjacent said securing means; said leveling portion including linear sections extending in opposite directions from said support portion, said linear sections being disposed in a single plane; said aligning portion including aiming sections, one of said aiming sections being located on each side of said support portion, a part of each aiming section being spaced from a corresponding part of the other aiming section a distance substantially equal to spacing between a user's eyes; whereby mounting said sighting apparaus through said securing means on a member to be sighted and focusing on a target along said member with both eyes open creates a double image including a pair of adjacent sighting apparatus in which the aiming sections overlap at a common point alighed with said target.

2. Sighting apparatus according to claim 1 wherein said connecting portion includes a yoke member slidably disposed on said post member and locking means operatively connected to said yoke member.

3. Sighting apparatus according to claim 2 wherein said yoke member includes horizontal slots for said linear sections and/or said aiming sections.

4. Sighting apparatus according to claim 1 wherein said connecting portion includes fastening means.

5. Sighting apparatus according to claim 1 wherein said linear sections form a unitary linear member extending in opposite directions from said connector portion.

6. Sighting apparatus according to claim 1 wherein said leveling portion and said aligning portion are independent of one another.

7. Sighting apparatus according to claim 1 wherein said leveling portion and said aligning portion are combined into a unitary member.

8. Sighting apparatus according to claim 1 wherein said linear sections are extensions of said aiming sections.

9. Sighting apparatus according to claim 1 wherein said aiming sections are disposed on said linear sections.

10. Sighting apparatus according to claim 1 wherein said aiming sections are disposed at an acute angle to said linear sections.

11. Sighting apparatus according to claim 1 wherein said aiming sections are disposed perpendicular to said linear sections adjacent the ends thereof.

12. Sighting apparatus according to claim 1 wherein said aiming sections include bar sections.

13. Sighting apparatus according to claim 1 wherein said linear sections and said aiming sections are wire members.

14. Sighting apparatus including a support portion, a connecting portion, a leveling portion and an aligning portion; said support portion including securing means disposed adjacent one end thereof, said support portion being affixable through said securing means to a member to be sighted; said connecting portion including connector means adjacent said securing means; said leveling portion including linear sections extending in opposite directions from said support portion, said linear sections being disposed in a single plane; said aligning portion including aiming sections, one of said aiming sections being located on each side of said support portion, a part of each aiming section being spaced from a corresponding part of the other aiming section a distance substantially equal to spacing between a user's eyes, said linear sections and said aiming sections being opaque areas disposed on a common base member; whereby mounting said sighting apparatus through said securing means on a member to be sighted and focusing on a target along said member with both eyes open creates a double image including a pair of adjacent sighting apparatus in which the aiming sections overlap at a common point aligned with said target.

15. Sighting apparatus according to claim 14 wherein said linear sections and/or said aiming sections are disposed along the periphery of said common base member.

16. Sighting apparatus according to claim 14 wherein said base member is connected to said support portion directly through said connecting portion.

* * * * *